US005888692A

United States Patent [19]

Voets et al.

[11] Patent Number: 5,888,692

[45] Date of Patent: Mar. 30, 1999

[54] METHOD FOR COATING CARRIER PARTICLES FOR USE IN ELECTROSTATIC DEVELOPERS

[75] Inventors: Raphaël Voets, Hever; Serge Tavernier, Lint; Gerrit Delen, Herselt, all of Belgium; Rainer Bellinghausen, Bomlitz, Germany

[73] Assignee: AGFA-Gevaert, N.V., Mortsel, Belgium

Related U.S. Application Data

[60] Provisional application No. 60/060,428, Sep. 30, 1997.

[21] Appl. No.: 135,567

[22] Filed: Aug. 18, 1998

[30] Foreign Application Priority Data

Aug. 20, 1997 [EP] European Pat. Off. ..... 97202551

[51] Int. Cl.[6] ..... G03G 9/113

[52] U.S. Cl. ..... 430/137; 430/106.6; 430/108; 427/213.36

[58] Field of Search ..... 430/106.6, 108, 430/137

[56] References Cited

U.S. PATENT DOCUMENTS

| | | | |
|---|---|---|---|
| 3,507,686 | 4/1970 | Hagenbach . | |
| 3,947,271 | 3/1976 | Munzel et al. | 430/122 |
| 4,599,290 | 7/1986 | Yoerger et al. | 430/108 |
| 4,822,708 | 4/1989 | Machida et al. | 430/106.6 |
| 5,061,593 | 10/1991 | Yoerger et al. | 430/108 |
| 5,102,769 | 4/1992 | Creatura | 430/137 |
| 5,340,677 | 8/1994 | Baba et al. | 430/106.6 |
| 5,393,631 | 2/1995 | Horikoshi et al. | 430/137 |
| 5,567,561 | 10/1996 | Yoshikawa et al. | 430/106.6 |
| 5,652,079 | 7/1997 | Mochizuki et al. | 430/108 |
| 5,709,975 | 1/1998 | Yoerger et al. | 430/137 |

FOREIGN PATENT DOCUMENTS

| | | |
|---|---|---|
| 0 694 818 A1 | 1/1996 | European Pat. Off. . |
| 39 26 029 A1 | 2/1990 | Germany . |
| 2 014 876 A | 9/1979 | United Kingdom . |

*Primary Examiner*—Roland Martin
*Attorney, Agent, or Firm*—Breiner & Breiner

[57] ABSTRACT

A method for coating carrier particles for use in electrostatic developers is provided comprising the steps of:

bringing the carrier particles to be coated in a vessel equipped with means for agitating the carrier particles, so that the carrier articles occupy less than 85% by volume of the vessel, and the agitation of the carrier particles is described by a Froude number between 0.2 and 20, adding a solution containing between 6 and 60% by weight with respect to the total volume of the solution of chemical compounds for coating the carrier particles in a solvent with a boiling point of A° C. to the vessel at such a rate that, at any time, the solvent is present in an amount lower than 1.25 $10^{-4}$ ml per $cm^2$ of surface of the carrier particles to be coated, keeping the carrier particles in the vessel at a temperature of at most (A+10)° C., and continuously evacuating the solvent.

16 Claims, No Drawings

METHOD FOR COATING CARRIER PARTICLES FOR USE IN ELECTROSTATIC DEVELOPERS

FIELD OF THE INVENTION

This invention relates to a method for coating carrier particles. It relates especially to a method for coating carrier particles to be used as carrier particles in multi-component developers for electrostatic imaging with magnetic brush development as well in cascade development. The invention is also very suitable to prepare coated glass beats for chromatographic purposes.

BACKGROUND OF THE INVENTION

There are several methods for coating solid with one of more chemical substances. The carrier particles can be added to a fluidised bed and the coating solution of a chemical substance in a solvent is then added to the fluidised bed and the solvent evaporated. This method gives good coating results, but the amount of air needed to form the fluidised bed is such that the evaporated solvent (which in most cases is an organic solvent) contaminates a large volume of air, which can not without further treatment be vented in the open atmosphere. Therefore the installations for fluidised bed coating are quite large and expensive. Moreover, in a fluidised bed the carrier particles are strongly agitated and many collisions occur which damage the coating around the carrier particles.

In an other method, the carrier particles are mixed (dispersed) in a solution of the chemical compound or compounds that are to be applied on the surface of the carrier particles and the particles are the spray-dried. Again this method gives good coating results, but the installation needed for spray drying is expensive.

In several documents it is disclosed to bring a solution of coating compounds in a low temperature boiling solvent in contact with the carrier particles to be coated in a vessel while mechanically stirring and to evaporate the solvent afterwards or simultaneously. Documents disclosing such methods are, e.g., U.S. Pat. No. 3,507,686, U.S. Pat. No. 3,947,271, U.S. Pat. No. 5,102,769, U.S. Pat. No. 5,340,677 and GB-A-2,014,876.

When coating carrier particles for use in electrostatic imaging the coating has to very homogenous over the surface of the particles to be coated. In electrostatographic imaging the carrier particles are mixed with toner particles (and with other ingredients) to form a developer. When the developer is to be used in magnetic brush development, the carrier particles are magnetic, when the developer is used in cascade development, the carrier particles can be coated glass beads. In any case the rubbing of the carrier particles and the toner particles induce a tribo-electric charge in the toner particles and the nature of the coating on the carrier particles determines, together with the toner ingredients, the polarity of the charge on the tone particles as well as the amount of the charge. When the coating of the surface of the carrier particles is not even and has interruptions, then problems in charging the toner particles can occur. Thus in coating carrier particles it is of utmost important to have an even, closed coating on the surface of the particles. In the prior art methods, frequently some of the particles adhere, during the process to the wall of container of the fluidised bed or spray drying apparatus, and these particles are only coated from 1 side.

Very homogenous coating of particles are not only desirable for carrier particles to be used in an electrostatic developer, but also for other particles, e.g., particles that are used in absorption chromatography.

Thus it is still desirable to have a simple, inexpensive, environmentally sound method for coating particles with an homogenous surface layer.

OBJECTS AND SUMMARY OF THE INVENTION

It is an object of the present invention to provide a method for coating carrier particles with chemical substances that is simple, fast and reliable and that makes it possible to apply a thin homogenous layer, without interruptions, on the surface of the particles.

It is a further object of the invention to provide a method for coating carrier particles in an environmental sound way wherein low amounts of organic solvent are used.

It is still an other object of the invention to provide a method for coating carrier particles wherein only a low volume of air is be contaminated by organic solvents and wherein said contaminated air is easily purified.

Further objects and advantages of the invention will become clear from the detailed description hereinafter.

The objects of the invention are realised by providing a method for coating carrier particles, having a volume average diameter between 20 and 200 $\mu$m, for use in electrostatic developers, comprising the steps of:

bringing said carrier particles to be coated in a vessel equipped with means for agitating said carrier particles, so that said carrier particles occupy less than 85% by volume of said vessel, and the agitation of the carrier particles is described by a Froude number between 0.2 and 20, adding a solution containing between 6 and 60% by weight with respect to the total volume of said solution of chemical compounds for coating said carrier particles in a solvent with a boiling point of A° C. to said vessel at such a rate that, at any time, said solvent is present in an amount lower than 1.25 $10^{-4}$ ml per $cm^2$ of surface of said carrier particles to be coated, keeping said carrier particles in said vessel at a temperature of at most (A+10)° C., and continuously evacuating said solvent.

DETAILED DESCRIPTION OF THE INVENTION

It was found that it was possible to form a loose bed of carrier particles by mechanical means instead of by an air flow as in a fluidised bed or spray coater. This loose bed of carrier particles can be formed in several ways. In a first embodiment, the particles to be coated are brought in a stationary vessel equipped with a mechanical stirrer, in a second embodiment, no stirrer is present in the vessel, but the vessel is vibrated by vibrating means, e.g. the vessel is mounted on a vibrating table. In a further useful embodiment of a vessel for implementing the method of this invention, the vessel is a tube, capped on both ends and after filling the tube with carrier particles to be coated, the tube is agitated, e.g., by rolling the tube parallel to its cylindrical axis. A vessel for implementing the method of this invention, can be of any type and the stirring of the carrier particles in the vessel can proceed by any means, e.g., by internal stirrers of any type, by external vibrating of the vessel or by rolling the vessel, as long as in the vessel the mechanical agitation of the carrier particles is described by a Froude number between 0.2 and 20, preferably between 0.5 and 8, both limits included. When the Froude number was out side of these limits the carrier particles tend to aggregate or the agitation is too heavy, so that damaging of the carrier particles and the coating can be introduced. The Froude number is a description of a specific ratio of inertia versus gravity forces, both forces being of importance in the description of agitation, as is discussed in the publication entitled KENZAHLEN UND ÄHNLICHKEITSGESETZE IM INGENIEURWESEN, by J. Stichlmair, p 33, published by Altos-verlag Doris Stichlmair Essen 1990. The Froude number can be calculated as a dimensionless number using the formula:

$$F=v^2/(g.l)$$

wherein v represents the velocity of mixing, e.g. circumferential speed of outer portion of mixing blade in m/sec, g is gravitational constant (9.81 m/sec$^2$), and l is a typical dimension of the mixing set-up expressed in m, e.g. radius of mixing blade.

In a preferred embodiment of this invention, the vessel for implementing the method of this invention is equipped with a stirrer of which the blades are essentially perpendicular (i.e. a deviation of 10 degrees is acceptable) to the bottom of the vessel. It was possible in such a device to mix enough air with the carrier particles to form a loose bed of particles. It was found that an adequate loose bed of particles could be produced when the carrier particles occupied at most 85% by volume of the vessel. It is preferred to rotate the stirrer at such a velocity that within the vessel the mechanical agitation of the particles is described by a Froude number between 0.2 and 20. preferably between 0.5 and 8, both limits included. Although any vessel and stirrer in a configuration described above can be used, it is highly preferred that the vessel is basically cylindrical and that walls of the cylinder are placed in a basically horizontal plane and that the shaft of the stirrer is mounted essentially parallel to the walls of the cylinder and the blades perpendicular to these walls. A very useful type of mixing apparatus to form a loose bed of particles in the method according to this invention is a ploughshare mixer. Such a mixer is, e.g., commercially available from Gebrüder Lödige Maschinenbau GmbH, D33050 Paderborn, Germany. In such a mixer the blades on the shaft of the stirrer have the shape of a ploughshare. Another interesting embodiment is the use of a vessel, mounted on a vibrating stage, as sold by Fritsch GmbH, Industriestrasse 8, Idar-Oberstein, W-Germany When in a mechanically agitated vessel device as described above, a solution of a coating compound containing between 6 and 60% by weight with respect to the total volume of said solution in a solvent, preferably between 15 and 40% by weight with respect to the total volume of said solution is added at such a rate that at any time of the coating process in the method of this invention for every cm$^2$ of the surface of all particles present in the vessel at most 1.25 $10^{-4}$ ml of solvent is present in the vessel a good coating of the particles could be assured. Preferably the rate of addition of the solution containing the coating compound is such that for every cm2 of the surface of all particles present in the vessel at most 0.6 $10^{-4}$ ml of solvent is present in the vessel. When the surface of the particles is calculated from the average volume diameter of the particles, (measured by sieve analysis) assuming the particles are a spherical, this amount boils down to particles having a layer of solvent that is at most about 1 $\mu$m thick. By keeping the amount of solvent low the coating compounds, once adhered to the particles are almost immediately dry and no or very low adherence of the particles to each other due to possible adhesive forces of the coating compounds occurs. The addition of the solution in the method of this invention can proceed by any means for rate-controlled injection of fluids known in the art. In can be single or multiple injection, multiple injection (i.e. injection over several nozzles) is preferred in the method of this invention since it gives even better homogeneity of the coating on the particles.

In the method of the invention, the temperature of the loose bed of particles (i.e. the temperature of the particles in the vessel) is held at a temperature that is at most 10° C. higher than the boiling point of the solvent that is used in the solution containing the coating compound. Thus when the boiling point of the solvent is A° C., then the temperature of the loose bed (i.e. the particles in the vessel) is kept at a temperature that is at most (A+10)° C., preferably the temperature in the vessel is at most (A+5)° C. When a mixture of solvents is used, the temperature of the loose bed of particles is held at a temperature that is at most 10° C. higher, preferably at most 5° C. higher, than the boiling point of the solvent with the lowest boiling point. In this invention the boiling point means the boiling point at the atmospheric pressure at which the coating is carried out. When the method of this invention is carried out at normal atmospheric pressure-, the boiling point to be considered is the boiling point at normal atmospheric pressure, when the coating proceeds at lowered pressure, then the boiling point to be considered is the boiling point at that lowered pressure.

The solvent is continuously evaporated. The apparatus is preferably a closed system, and the solvent is evaporated from the agitated vessel, and is recovered by trapping the solvent in a cooler.

The method according to the present invention, works very well when the particles to be coated have an average weight, $W_{avg}$, calculated by multiplying the specific gravity of the particles—expressed in Kg/m$^3$ —with the average volume of the particle calculated from the average volume diameter—expressed in m—of the particle while considering the particles as a sphere) such that 1 $10^{-11}$ Kg$\leqq W_{avg} \leqq$5 $10^{-8}$ Kg. The method of this invention is especially well suited for coating particles with an average weight $W_{avg}$such that 1 $10^{-10}$Kg $\leqq W_{avg} \leqq$1 $10^{-8}$ Kg.

After coating the coated particles can be post-treated in the vessel and the temperature, stirring speed, etc. can be adjusted to assure a good post-treatment. Such a post-treatment can, e.g., be desirable to evacuate traces of solvent, of moisture, etc. The post-treatment can also be desirable to harden the coating. The post-treatment can proceed inside the vessel wherein the coating by the method of this invention has been carried out, as well as outside the vessel, if so desired, in a rolling drum, an oven etc. During post-treatment, the coated particles can be agitated as well as not.

The method of this invention is very well suited to produce particles with a layered coating. The method of this invention, makes it possible to coat particles with a very thin, homogeneous layer of chemical compounds and thus the application of several such layers by this method poses little or no problems. It is, e.g., possible to coat particles in a method according to this invention with a primer layer designed to help the adherence of the functional layer to the particles. This primer layer can then, if desired receive a post-treatment as described above, and then the particles with the primer layer are further coated with a functional layer in a method according to this invention. Then, if desired, the particles with primer layer and functional layer can receive a post-treatment as described above. An then it is possible to overcoat, in the method of this invention, the functional layer on the particles with a protective layer.

When coating multiple layers, the solvent of the various compositions, the reaction temperatures, the Froude numbers are adjusted, within the limits described in this document, to have the desired coating thickness, strength, etc.

The method according to the present invention is also very suited to coat particles for use in chromatography.

Carrier particles coated in a method of the present invention can be used to prepare multi-component developers for use in electrostatographic methods were an electrostatic latent image has to be developed, e.g., ionography, electrophotography as well as in electrostatographic methods were toner particles are directly image-wise applied to a final image receiving substrate as in Direct Electrostatic Printing, described in e.g. EP-A-675 417.

When the developer is used ,e.g. in cascade development, the carrier particles can be glass particles that have been coated in the method according to this invention, when the developer is used in magnetic brush development, the carrier particles contain magnetic material or are magnetic particles. The method of this invention can be used to coat composite carriers (carrier wherein a magnetic pigment is incorporated in a matrix, this matrix being e.g. a resin, glass, etc . . . ) as well as carriers composed of pure magnetic material. As magnetic material as well metal, metaloxides, as any magnetisable material can be used, the metal and metal derivatives of metals typically selected from the group of Ca, Cr, Mn, Fe, Co, Ni, Cu, and Zn.

The method according to the present invention can be used for any type of coating, it can be used to coat polymers on the particles, e.g., addition polymers comprising styrene moieties, acrylic moieties, etc., addition polymers, e.g., polyesters, polyamides, polyimides etc., polymers comprising fluor containing moieties, silicon containing polymers, etc. The method can as well be used to coat particles with mixtures of polymers. The method of this invention can also be used to coat reactive mixtures on the particles, e.g., silicone polymers together with functional organosilanes as disclosed in U.S. Pat. No. 4,977,054. The method of this invention is very well suited for coating particles with a solution of chemical compounds that are selected from the group consisting of a monomeric, polyfunctional organosilane, a product of the hydrolysis of a monomeric, polyfunctional organosilane, a reaction product of a monomeric, polyfunctional organosilane and a organosilane containing an hetero-atom and a reaction product of a monomeric, polyfunctional organosilane and an alkoxide. These compounds have been disclosed as carrier coating in the German Application 19721626.9 of May 23, 1997, titled coated particles, that is incorporated by reference.

EXAMPLE

A small laboratory equipment is described, comprising a 2 l three-neck glass vessel, equipped with a mechanical stirrer, a condenser and a n injection system for the coating solution. The vessel is filled with 1 kg of ferrite powder, with a specific gravity of 5 g/cm$^3$ and a volume average particle size, determined by sieve analysis of 50 $\mu$m, thus giving a $W_{avg}$-value of 3.3 $10^{-10}$ Kg. 100 ml of coating solution containing 10 g of a styrene/acrylic copolymer in methylenechloride is added drop-wise over 60 minutes. The product temperature (the temperature of the particles) is set at 45° C., and a small underpressure is used to remove evaporated solvent. The particles are stirred at 300 rpm. The radius of the stirring blade being 5 cm. This set-up is characterised by a Froude number equal to 5. After addition of the coating solution, the temperature is risen to 75° C. for 2 hours to remove all solvent and harden the coating. Visual inspection by microscope reveals high quality of the coating. An electrophotographic developer was prepared by admixing 5% of toner. Good perfomance was observed in a copying device.

We claim:

1. A method for coating carrier particles, having a volume average diameter between 20 and 200 $\mu$m, for use in electrostatic developers, comprising the steps of:

bringing said carrier particles to be coated in a vessel equipped with means for agitating said carrier particles, so that said carrier particles occupy less than 85% by volume of said vessel, and the agitation of the carrier particles is described by a Froude number between 0.2 and 20, adding a solution containing between 6 and 60% by weight with respect to the total volume of said solution of chemical compounds for coating said carrier particles in a solvent with a boiling point of A° C. to said vessel at such a rate that, at any time, said solvent is present in an amount lower than 1.25 $10^{-4}$ ml per cm$^2$ of surface of said carrier particles to be coated, keeping said carrier particles in said vessel at a temperature of at most (A+10)° C., and continuously evacuating said solvent.

2. A method according to claim 1, wherein said Froude number is between 0.5 and a both limits included.

3. A Method according to claim 1, wherein said solution contains between 15 and 40% by weight with respect to the total volume of said solution of chemical compounds for coating said particles.

4. A method according to claim 1, wherein said solution is added to said vessel at a rate that, at any time, said solvent is present in an amount lower than 0.6 $10^{-4}$ ml per cm$^2$ of surface of said particles to be coated.

5. A method according to claim 1, wherein said carrier particles have an average weight $W_{avg}$ such that $1 \cdot 10_{-11}$ Kg$\leqq W_{avg} \leqq 5 \cdot 10_{-8}$ Kg.

6. A method according to claim 1, wherein said carrier particles have an average weight $W_{avg}$ such that $1 \cdot 10_{-10}$ Kg$\leqq W_{avg} \leqq 1 \cdot 10_{-8}$ Kg.

7. A method according to claim 1, wherein said vessel with a mechanical mixer is a ploughshare mixer.

8. A method according to claim 1, wherein said chemical compounds are selected from the group consisting of (a monomeric, polyfunctional organosilane, an hydrolysis product of a monomeric, polyfunctional organosilane, a reaction product of a monomeric, polyfunctional organosilane and a organosilane containing an hetero-atom and a reaction product of a monomeric, polyfunctional organosilane and an alkoxide.

9. A method according to claim 1, wherein said carrier particles comprise magnetic material.

10. A Method according to claim 2, wherein said solution contains between 15 and 40% by weight with respect to the total volume of said solution of chemical compounds for coating said particles.

11. A method according to claim 2, wherein said solution is added to said vessel at a rate that, at any time, said solvent is present in an amount lower than 0.6 $10^{-4}$ ml per cm$^2$ of surface of said particles to be coated.

12. A method according to claim 2, wherein said carrier particles have an average weight $W_{avg}$ such that $1 \cdot 10_{-11}$ Kg$\leqq W_{avg} \leqq 5 \cdot 10_{-8}$ Kg.

13. A method according to claim 2, wherein said carrier particles have an average weight $W_{avg}$ such that $1 \cdot 10_{-11}$ Kg$\leqq W_{avg} \leqq 1 \cdot 10_{-8}$ Kg.

14. A method according to claim 2, wherein said vessel with a mechanical mixer is a ploughshare mixer.

15. A method according to claim 2, wherein said chemical compounds are selected from the group consisting of (a monomeric, polyfunctional organosilane, an hydrolysis product of a monomeric, polyfunctional organosilane, a reaction product of a monomeric, polyfunctional organosilane and a organosilane containing an hetero-atom and a reaction product of a monomeric, polyfunctional organosilane and an alkoxide.

16. A method according to claim 2, wherein said carrier particles comprise magnetic material.

* * * * *

UNITED STATES PATENT AND TRADEMARK OFFICE

CERTIFICATE OF CORRECTION

PATENT NO. : 5,888,692

DATED : March 30, 1999

INVENTOR(S) : Raphaël Voets et al

It is certified that error appears in the above-indentified patent and that said Letters Patent is hereby corrected as shown below:

Column 3, line 10, "Altos-verlag" should read -- Altos-Verlag -- .

Column 3, line 17, "l" should read -- ℓ --.

Column 6, Claim 5, line 37, "$10_{-11}$" should read -- $10^{-11}$ --.

Column 6, Claim 5, line 38, "$10_{-8}$" should read -- $10^{-8}$ --.

Column 6, Claim 6, line 40, "$10_{-10}$" should read -- $10^{-10}$ --.

Column 6, Claim 6, line 41, "$10_{-8}$" should read -- $10^{-8}$ --.

Column 6, Claim 12, line 63, "$10_{-11}$" should read -- $10^{-11}$ --.

Column 6, Claim 12, line 64, "$10_{-8}$" should read -- $10^{-8}$ --.

Column 6, Claim 13, line 66, "$10_{-11}$" should read -- $10^{-11}$ --.

UNITED STATES PATENT AND TRADEMARK OFFICE

CERTIFICATE OF CORRECTION

PATENT NO. : 5,888,692 Page 2 of 2

DATED : March 30, 1999

INVENTOR(S) : Raphaël Voets, et al

It is certified that error appears in the above-identified patent and that said Letters Patent is hereby corrected as shown below:

Column 6, Claim 13, line 67, "$10_{-8}$" should read -- $10^{-8}$--.

Signed and Sealed this

Seventh Day of December, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,888,692

DATED : March 30, 1999

INVENTOR(S) : Raphaël Voets et al

It is certified that error appears in the above-indentified patent and that said Letters Patent is hereby corrected as shown below:

Column 3, line 10, "Altos-verlag" should read -- Altos-Verlag -- .

Column 3, line 17, "l" should read -- ℓ --.

Column 6, Claim 5, line 37, "$10_{-11}$" should read -- $10^{-11}$ --.

Column 6, Claim 5, line 38, "$10_{-8}$" should read -- $10^{-8}$ --.

Column 6, Claim 6, line 40, "$10_{-10}$" should read -- $10^{-10}$ --.

Column 6, Claim 6, line 41, "$10_{-8}$" should read -- $10^{-8}$ --.

Column 6, Claim 12, line 63, "$10_{-11}$" should read -- $10^{-11}$ --.

Column 6, Claim 12, line 64, "$10_{-8}$" should read -- $10^{-8}$ --.

Column 6, Claim 13, line 66, "$10_{-11}$" should read -- $10^{-10}$ --.

UNITED STATES PATENT AND TRADEMARK OFFICE

CERTIFICATE OF CORRECTION

PATENT NO. : 5,888,692

DATED : March 30, 1999

INVENTOR(S) : Raphaël Voets et al

It is certified that error appears in the above-indentified patent and that said Letters Patent is hereby corrected as shown below:

Column 6, Claim 13, line 67, "$10_{-8}$" should read -- $10^{-8}$--.

This certificate supersedes Certificate of Correction issued December 7, 1999.

Signed and Sealed this

Eighth Day of February, 2000

*Attest:*

*Attesting Officer*

Q. TODD DICKINSON

*Commissioner of Patents and Trademarks*